United States Patent [19]

Ellen

[11] 4,036,921

[45] July 19, 1977

[54] METHOD OF MAKING A CURVED ROOF

[76] Inventor: Peter Edington Ellen, 16 Cornwall Avenue, Turramurra, New South Wales, Australia

[21] Appl. No.: 611,510

[22] Filed: Sept. 8, 1975

[51] Int. Cl.[2] ..... E04B 1/16; E04B 1/132; E04G 21/00

[52] U.S. Cl. ..... 264/32; 52/640; 264/31; 264/228; 29/155 R; 29/448; 52/223 R; 52/741

[58] Field of Search ..... 52/223–230, 52/340, 80, 83, 639, 640; 264/31, 228, 229, 32, 22 B; 29/155 R, 448, 452

[56] References Cited

U.S. PATENT DOCUMENTS

| | | | |
|---|---|---|---|
| | 10/1835 | Witty | |
| 1,940,401 | 12/1933 | Dischinger | 52/80 |
| 2,415,709 | 2/1947 | Sechaud et al. | 52/640 |
| 2,425,079 | 8/1947 | Billig | 52/224 |
| 2,510,958 | 6/1950 | Coff | 52/225 |
| 2,725,612 | 12/1955 | Lipski | 264/228 |
| 2,809,074 | 10/1957 | McDonald | 52/225 |
| 2,963,273 | 12/1960 | Lane | 52/223 |
| 3,885,369 | 5/1975 | Ott | 52/340 |

FOREIGN PATENT DOCUMENTS

| | | | |
|---|---|---|---|
| 1,202,577 | 7/1959 | France | 52/223 |

*Primary Examiner*—Price C. Faw, Jr.
*Assistant Examiner*—James L. Ridgill, Jr.

[57] ABSTRACT

A roof structure consisting of a thin curved slab of reinforced concrete which is initially cast by conventional techniques as a flat slab, tension cables (preferably of high tensile steel) extending in one or more directions being arranged across the slab and being connected to opposite edges of the slab and also connected to the slab at points along their lengths by means of tensioned hangers or compression props or columns of predetermined lengths, tension then being applied to the cables to cause them to straighten and in so doing to cause the concrete slab to take up a curved shape so as to form a shell structure which resists applied loads by reason of its curved shape.

8 Claims, 12 Drawing Figures

METHOD OF MAKING A CURVED ROOF

The present invention relates to roof structures and more particularly to roof structures consisting of a single thin slab of reinforced concrete.

The object of the invention is to enable a roof structure of this kind to be constructed which, while structurally suitable and effective for its purpose enables construction to be carried out with a considerable economy in labour and materials.

The invention consists in a roof structure consisting of a thin curved slab of reinforced concrete which is initially cast by conventional techniques as a flat slab, tension cables (preferably of high tensile steel) extending in one or more directions being arranged across the slab and being connected to opposite edges of the slab and also connected to the slab at points along their lengths by means of tensioned hangers or compression props or columns of predetermined lengths, tension then being applied to the cables to cause them to straighten and in so doing to cause the concrete slab to take up a curved shape so as to form a shell structure which resists applied loads by reason of its curved shape.

The cables may be arranged above, or below the slab in accordance with the structure desired.

Figure 1:
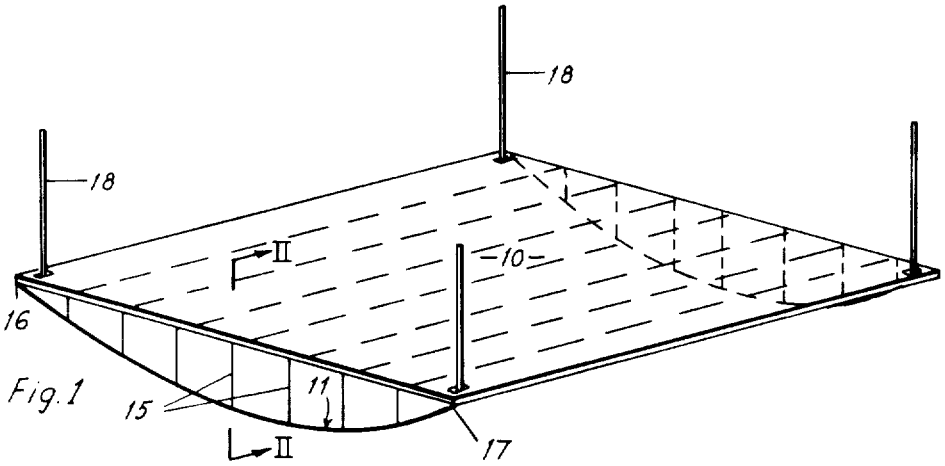
Figure 2:
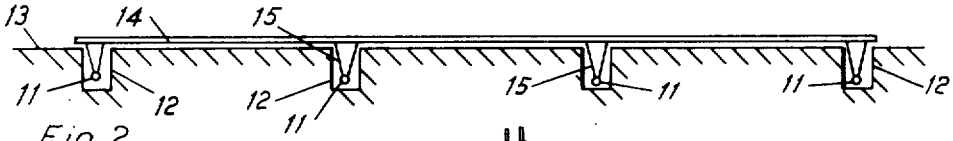
Figure 3:
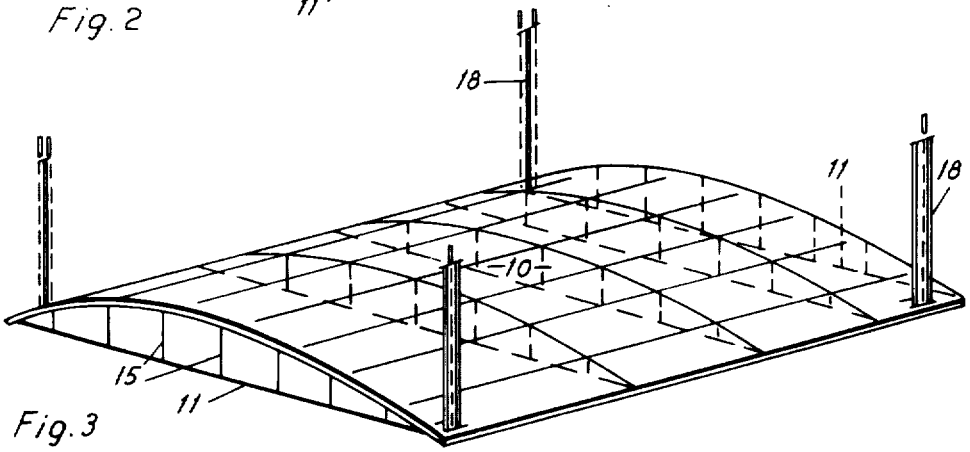
Figure 4:
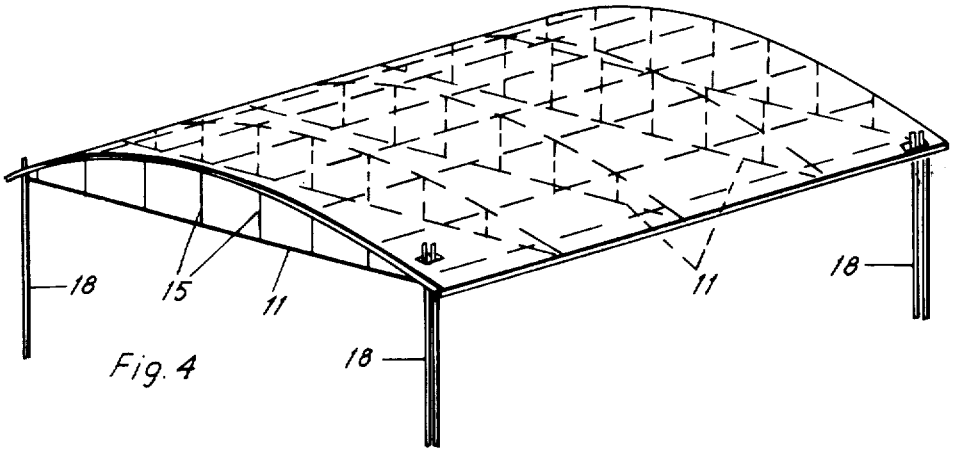
Figure 5:
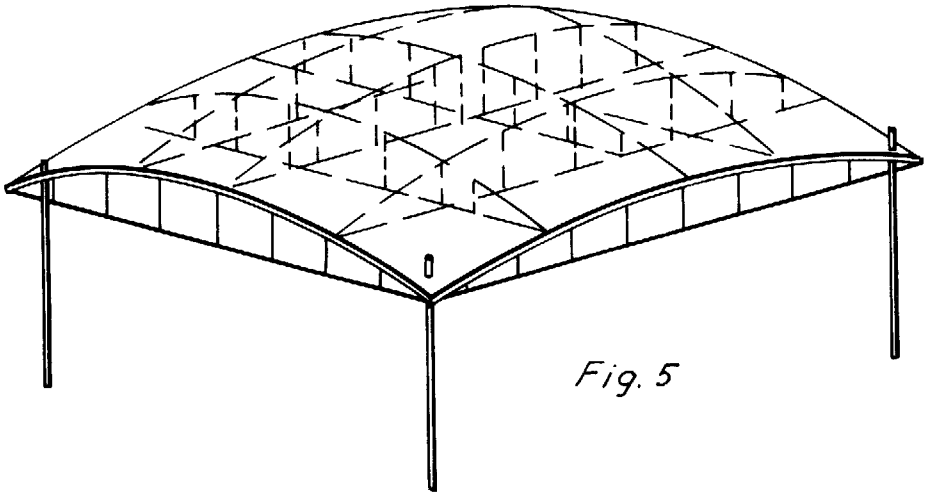
Figure 6:
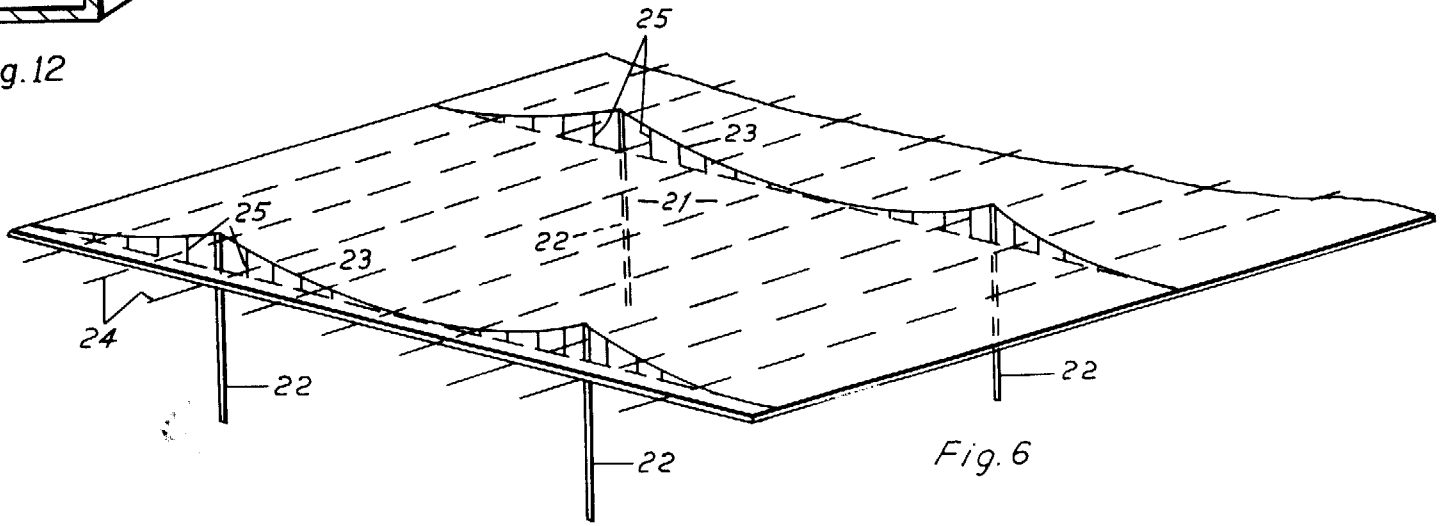
Figure 7:
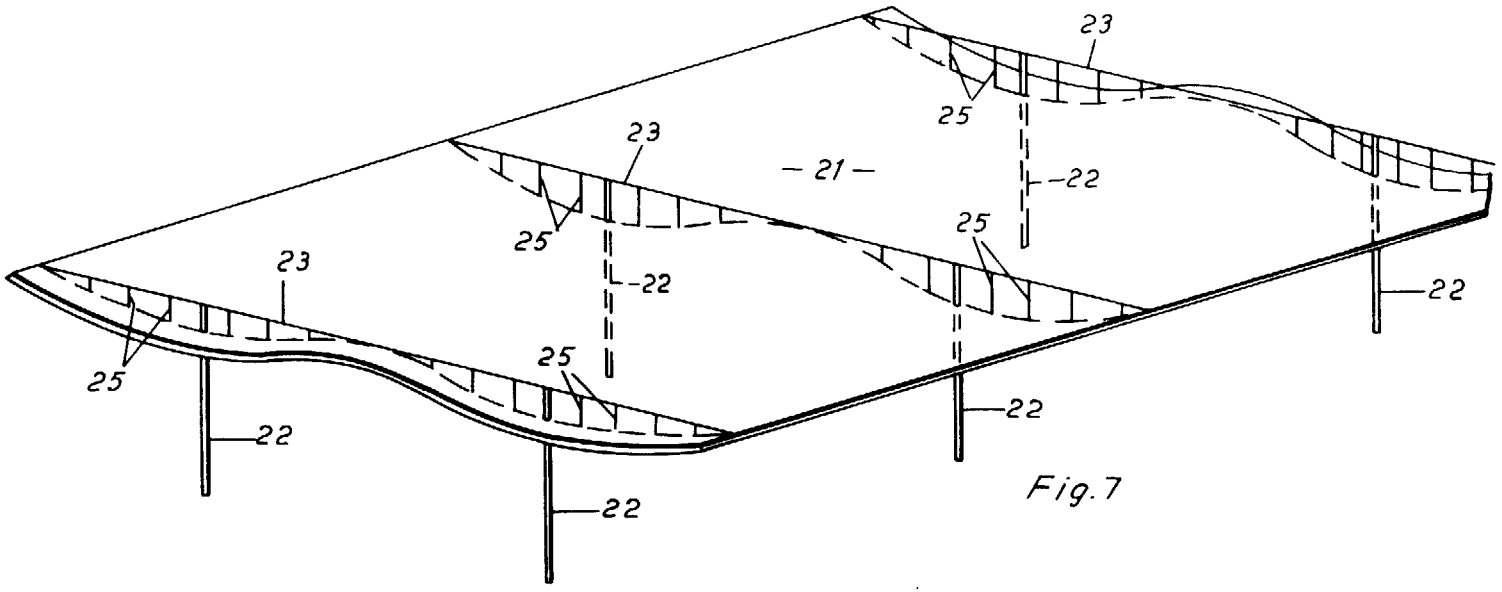
Figure 11:
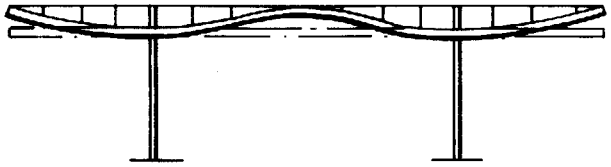
Figure 10:
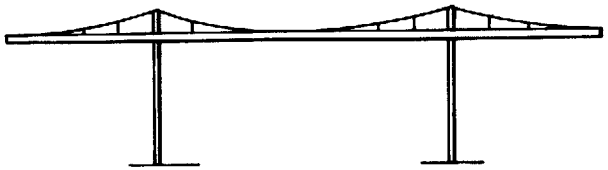
Figure 8:
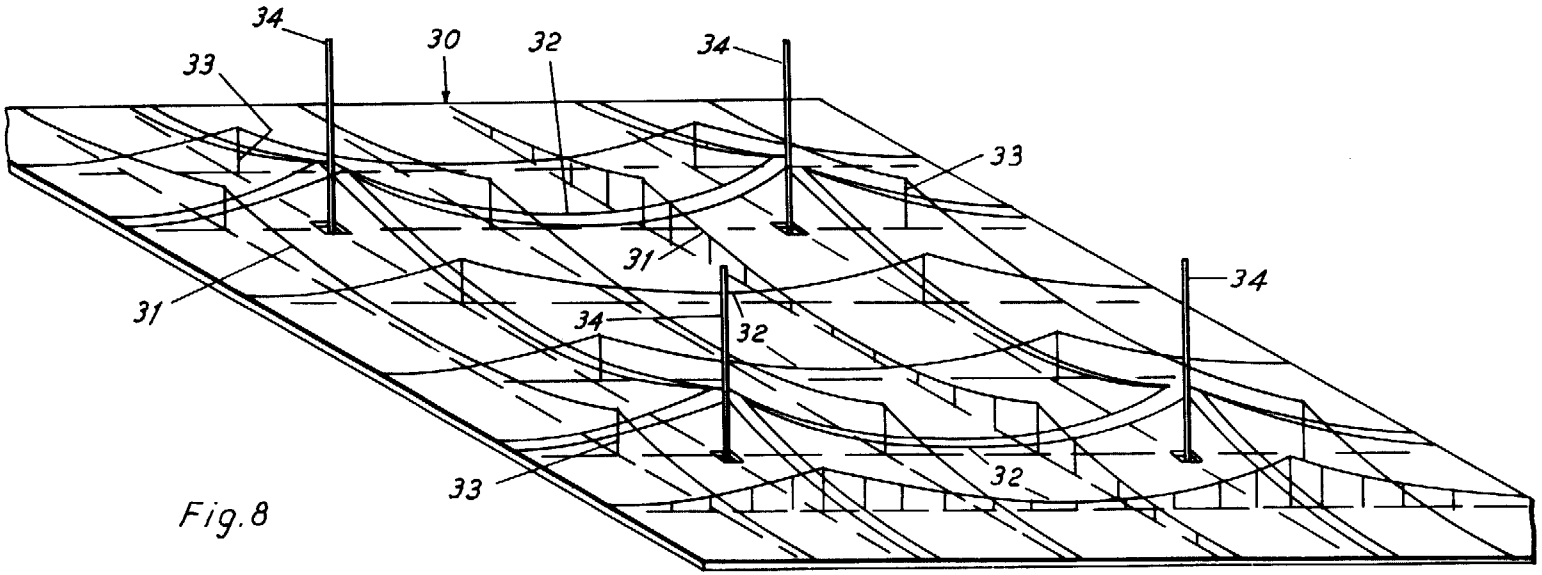
Figure 9:
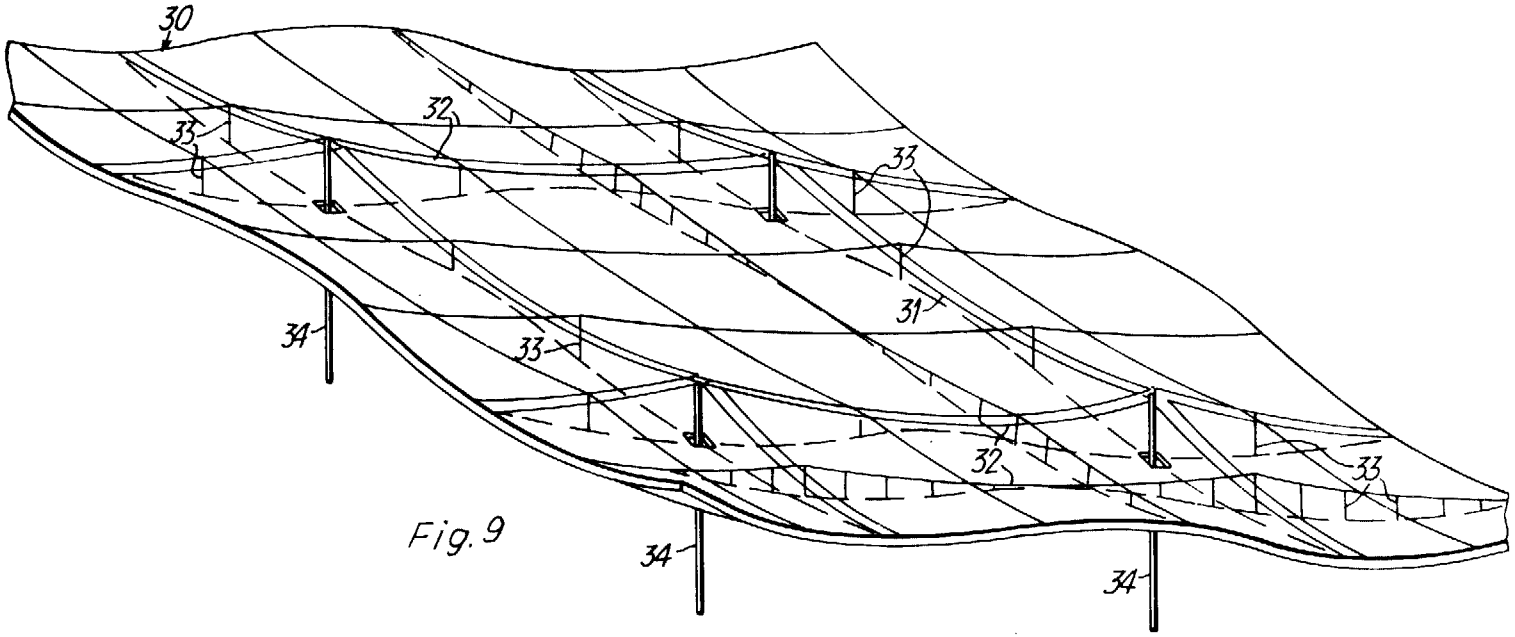

In order that the invention may be better understood and put into practice preferred forms thereof are herinafter described, by way of example, with reference to the accompanying diagrammatic drawings in which:

FIG. 1 illustrates the manner in which a roof comprising a single shell of single curvature with underslung cables is formed, FIG. 2 is a section on plan 11—11 of FIG. 1, FIG. 3 shows the form of the roof after tension has been applied to the cables, FIG. 4 shows the roof elevated into position on the top of columns, FIG. 5 shows a double curvature shell roof of single span with underslung cables, FIG. 6 shows a roof having top slung cables extending in a single direction, prior to tensioning the cables, FIG. 7 shows the roof of FIG. 6 after the cables have been tensioned, FIG. 8 shows a slab supported on four columns before tensioning the cables, and FIG. 9 shows the slab of FIG. 8 to which a double curvature has been imparted by tensioning topslung cables, FIG. 10 shows a roof construction similar to that of FIG. 6 but with a multiplicity of bays before cable tensioning, and FIG. 11 shows the roof of FIG. 10 after the cables have been tensioned.

Figure 12:
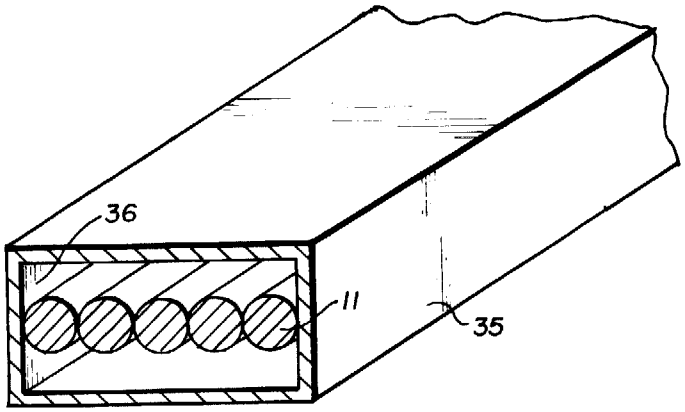

FIG. 12 is a perspective view partly in cross section of a steel tube for encasing the cables.

FIGS. 1 to 4 illustrate what is possibly the simplest application of the invention; a thin flat rectangular slab 10 of reinforced concrete is cast, the thickness of which is between 0.5 inches and 4 inches, the slab having a reinforcing steel percentage ranging from zero to 10% of the concrete area if required to control the moment rotation capacity of the slab.

For those slab sections where high moment rotation capacity is required high percentages of steel reinforcement may be necessary to control concrete slab cracking and waterproofness.

Prior to the casting of the slab tension cables 11 are laid in a series of parallel grooves 12 extending across the casting surface 13, the grooves 12 being shaped so that the cables assume a substantially parabolic shape they would take up if freely suspended from each end. When in this state, the cables are attached to the reinforcing material 14 of the slab, prior to casting, by means of struts 15 which principally resist compression but may resist tension, arranged at intervals along each cable 11. The cables 11 themselves are spaced to suit the loads applied across the dimension of the slab 10. Each cable 11 is connected to the slab 10 at points such as 16 and 17 on opposite edges of the slab. The slab is then cast. The cables 11 are then tensioned by jacks (not shown) in such a manner that the loads are approximately uniformly applied to avoid excessive loads in any one section. The effect of this is to cause the cables to straighten and the concrete slab to bow upwardly into an arch of substantially parabolic curvature as shown in FIG. 3. The concrete shell is locked in the shape so formed by means of the attached cables 11 and the compression struts 15.

If the shell thus produced is supported along the two edges to which the cables are secured, it will produce a roof which resists applied loads by its shape effect. It is found that various stiffnesses are produced depending upon the rise to span ratio and for practical applications a rise-span ratio of slightly more than zero to 1/6th is suitable and is preferably within the range of from 1/30th to 1/50th.

The roof is finally elevated to the top of the column 18 as shown in FIG. 4 by conventional means.

Alternatively the slab of concrete may be supported by two or more sets of cables so positioned to provide an upward lift to the slab substantially uniformly applied so that the slab would be curved in more than one direction. The shell shape so formed would enable the slab to support applied loads.

This possibility is illustrated in FIG. 5. The method of construction used is similar to that described above; in this case however the casting floor is provided with shaped grooves extending in two directions at right angles.

The cables instead of being arranged below the slab may be arranged above it. An example of such a construction is shown in FIG. 6 and 7. A flat slab 21 is cast on suitable frame work (not shown) and is supported by columns 22. Cables 23 are connected to opposite edges of the slab and are supported from the columns 22 at points above the level of the slab. Straight cables 24 pass through the slab in a direction at right angles to the cables 23 for the purpose of compressing the slab in this direction.

The cables 23 are connected to the reinforcing material of the slab 21 by tensioned hangars 25 the lengths of which are calculated to give the desired curvature to the slab. The cables 23 are tensioned until they become almost straight and this leads the slab 21 to take up the configuration shown in Fig. 7.

It will generally be convenient to cast the slab at a level lower than roof level. After tensioning the cables 23 the slab which now constitutes a stable structure may be elevated to its final position on the colums 22 by hydraulic jacks.

In this construction it will be seen that the roof is curved in one direction only.

A more interesting application of the invention arises from the casting of a rectangular slab of thin reinforced concrete with four supporting pillars being sited in a symmetrical relationship within the perimeter of the slab as is illustrated in FIGS. 8 and 9.

After casting the slab 30, tension cables 31 and 32 are laid above this slab attached to it at regular intervals by tensioned hangars or compression props or columns 33 of predetermined length, a number of cables 31 and 32 in each direction pass over the columns 34 and are draped in perobolic or catenary shapes from column to column and from each column 34 to an edge of the slab 30. The remaining cables pass over these cables and are supported by them. All cables 31 and 32 are then tensioned by jacks (not shown) in such a manner that the loads are applied approximately uniformly to avoid excessive upward loads in any one section. When the loads are applied the curved cables 31 and 32 tend to become straight and the straight concrete slab 30 tends to adopt a perabolic curvature until stability is reached in the configuration shown in FIG. 9. In this embodiment the application of the cables 31 in one direction and 32 in a direction at right angles produces a concrete shape of multiple curvature.

This curvature gives a controllable stiffness factor depending on the rise to span ratios. Furthermore it is found that thinner slabs may be bent to a larger curvature than thicker slabs but will produce a suitable stiffness according to the rise span ratio.

The shell structure so formed is supported above the area to be covered by the columns 34 referred to above.

FIGS. 10 and 11 show a variation on the construction just described in that six columns are utilised to produce an additional number of bays. FIG. 10 shows the roof as cast before the cables are tensioned and FIG. 11 shows the effect of tensioning the cables.

Structures are at present in use in which a flat slab is supported by columns to constitute a roof. It is found, however, that by using the form of structure described above, a very substantial saving in labour and material costs may be effected. This, of course, is achieved at the expense of departing from the flat shape of the roof which has been adopted hitherto. In many applications, however, not only is this acceptable but it can add to the appearance of the structure.

Further, it may be required to make use of a partial membrane dome effect by casting the slab flat, applying the upward cable loads to produce a shallow dome but limiting this dome to a required shape prior to the uplift cables becoming straight and hence stable. The structure so formed is in fact unstable but stability may be restored by encasing the tensioned cables in steel tubes 35, as shown in FIG. 12 which become compressed when the cables are tensioned. The degree of compression in these tubes controls the upward deflection of the membrane slab. To provide a controlled deflection in the slab these tubes may be allowed to buckle and deform thus shortening the compression struts so formed and allowing the membrane slab to deflect upward. The controlled deflection is achieved by varying the void space 36 between the tensioned cable and the inner tube wall and the effective length between the tension hangars or compression struts applying the load from the cables to the slab. In this manner the membrane dome shape may be controlled without the tension cables becoming completely straight.

The embodiments of the invention described above are given by way of example only to illustrate the nature of the invention the novelty of which lies in the idea of forming a stable structure by the deformation of a flat reinforced concrete slab by means of high tensile cables into a curved structure which resists applied loads by its shape effect.

I claim:

1. A method of constructing a curved roof structure from a reinforced concrete slab comprising arranging reinforcement elements for a concrete slab in a substantially flat plane, supporting at spaced points a plurality of tension cables extending in at least one direction across the reinforcing elements curving at least a portion of each cable in a substantially parabolic shape, attaching struts of predetermined lengths to spaced points along the tension cables and to the reinforcing elements in accordance with the substantially parabolic shape of the cables, casting a flat concrete slab about the reinforcing elements and thereafter uniformly tensioning the cables thereby reducing curvature thereof and curving the concrete slab to form a curved roof structure capable of resisting applied loads because of its curved shape.

2. A method of constructing a curved roof structure as claimed in claim 1 wherein the tension cables are supported above the reinforcing elements.

3. A method of constructing a curved roof structure as claimed in claim 1 wherein the tension cables are supported below the reinforcing elements.

4. A method of constructing a curved roof structure as claimed in claim 1 wherein the tension cables extend in one direction only across the reinforcing elements.

5. A method of constructing a curved roof structure as claimed in claim 1 wherein the plurality of tension cables extend in two directions at right angles to each other across the reinforcing elements.

6. A method of constructing a curved roof structure as claimed in claim 1 and further comprising supporting at least some of the tension cables on a plurality of columns located in symetrical relationships with in the perimeter of the reinforcing elements.

7. A method of constructing a curved roof structure as claimed in claim 1 wherein the tension cables are tensioned only to an extent which retains a degree of curvature thereof after tensioning and further comprising encasing the tension cables in compressible steel tubes which are compressed when the cables are tensioned to prevent tensioning the cables to form a straight line.

8. A method of constructing a curved roof structure as claimed in claim 7 wherein the steel tubes are compressible by a controlled amount to provide controlled curvature of the concrete slab.

* * * * *